US010794337B2

(12) United States Patent
Yang et al.

(10) Patent No.: US 10,794,337 B2
(45) Date of Patent: Oct. 6, 2020

(54) EGR COOLER

(71) Applicants: Hyundai Motor Company, Seoul (KR); Kia Motors Corporation, Seoul (KR)

(72) Inventors: Il Suk Yang, Hwaseong-si (KR); Yongpyo Hong, Seoul (KR); Seung Hoon Lee, Suwon-si (KR); Junghyeok Lim, Bucheon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/428,543

(22) Filed: May 31, 2019

(65) Prior Publication Data

US 2020/0182201 A1 Jun. 11, 2020

(30) Foreign Application Priority Data

Dec. 6, 2018 (KR) ..... 10-2018-0155998

(51) Int. Cl.

| | |
|---|---|
| ***F02M 26/32*** | (2016.01) |
| ***F02M 26/15*** | (2016.01) |
| ***F01P 3/20*** | (2006.01) |
| ***F02M 26/05*** | (2016.01) |
| ***F02M 26/06*** | (2016.01) |

(52) U.S. Cl.

CPC ..... *F02M 26/32* (2016.02); *F01P 3/20* (2013.01); *F02M 26/05* (2016.02); *F02M 26/06* (2016.02); *F02M 26/15* (2016.02); *F01P 2060/00* (2013.01)

(58) Field of Classification Search

CPC ..... F02M 26/15; F02M 26/22; F02M 26/28; F02M 26/29; F02M 26/30; F02M 26/32; F02M 26/41; F02M 26/05; F02M 26/06; F02F 7/007

See application file for complete search history.

(56) References Cited

U.S. PATENT DOCUMENTS

| | | | | |
|---|---|---|---|---|
| 6,360,702 | B1 * | 3/2002 | Osada | F28D 7/0066 123/196 AB |
| 2005/0000497 | A1 * | 1/2005 | Nakai | F02B 31/085 123/568.12 |
| 2016/0208745 | A1 * | 7/2016 | Neher | F02M 26/31 |
| 2017/0107952 | A1 | 4/2017 | Yang | |

FOREIGN PATENT DOCUMENTS

KR 2017004476 A 4/2017

* cited by examiner

*Primary Examiner* — Jesse S Bogue
*Assistant Examiner* — Loren C Edwards
(74) *Attorney, Agent, or Firm* — Slater Matsil, LLP

(57) ABSTRACT

An EGR (exhaust gas recirculation) cooler includes a cylinder block having a mounting space and having a coolant inlet in which a coolant can flow into the mounting space and a coolant outlet in which the coolant can be exhausted. A cover plate covers the mounting space and forms an exhaust inlet though which the exhaust gas can flow in and an exhaust outlet through which the exhaust gas can be exhausted. Tubes are mounted in the mounting space and through which the exhaust gas can flow. An inlet tank is mounted in the mounting space and is configured to distribute the exhaust gas flowing through the exhaust inlet of the cover plate to the tubes. An outlet tank is mounted in the mounting space and is configured to guide the exhaust gas exhausted from the tubes to the exhaust outlet of the cover plate.

20 Claims, 10 Drawing Sheets

EGR COOLER

CROSS-REFERENCE TO RELATED APPLICATIONS

This application claims priority to Korean Patent Application No. 10-2018-0155998, filed in the Korean Intellectual Property Office on Dec. 6, 2018, which application is hereby incorporated herein by reference.

TECHNICAL FIELD

The present invention relates to an exhaust gas recirculation (EGR) cooler and, in particular embodiments, to an EGR cooler installed at a cylinder block.

BACKGROUND

An exhaust gas recirculation (EGR) system is a system installed in a vehicle to reduce harmful exhaust gases.

Generally, NOx is increased when the proportion of air in a mixer is high and combustion is good. Therefore, the EGR system is a system for mixing a portion (for example, 5% to 20%) of an exhaust gas discharged from an engine again in the mixer to reduce the amount of oxygen in the mixer and obstruct combustion, thereby suppressing the occurrence of NOx.

Generally, since exhaust gas exhausted from the engine has very high temperature, the EGR system has a EGR cooler in order to reduce temperature of the recirculated exhaust gas.

The related art EGR cooler includes a cooling structure installed inside a separate housing, requires various components such as a nipple, or the like, for connecting a recirculation line through which a recirculating gas flows outside of the housing, and incurs high manufacturing cost of a vehicle due to an increase in length of the recirculation line.

Also, since it is difficult to firmly fix the EGR cooler inside the vehicle, the EGR cooler housing wobbles, while the vehicle is driving, causing excessive vibration.

The above information disclosed in this Background section is only for enhancement of understanding of the background of the invention and therefore it may contain information that does not form the prior art that is already known in this country to a person of ordinary skill in the art.

SUMMARY

Embodiments of the present invention can provide an exhaust gas recirculation (EGR) cooler having advantages of reducing manufacturing cost of a vehicle.

Embodiments of the present invention can also provide an EGR cooler having advantages of reducing vibration caused as a vehicle is driving.

An EGR (exhaust gas recirculation) cooler according to an exemplary embodiment of the present invention may include a cylinder block having a mounting space and having a coolant inlet in which a coolant is flowing into the mounting space and a coolant outlet in which the coolant is exhausted. A cover plate covers the mounting space and forms an exhaust inlet though which the exhaust gas is flow in and an exhaust outlet through which the exhaust gas is exhausted. A plurality of tubes is mounted in the mounting space. The exhaust gas flows in the tubes. In inlet tank is mounted in the mounting space and distributes the exhaust gas flowing through the exhaust inlet of the cover plate to the tubes. An outlet tank is mounted in the mounting space and guides the exhaust gas exhausted from the tubes to the exhaust outlet of the cover plate.

The plurality of tubes may be stacked in left-and-right direction and up-and-down direction. At least one spacer may be formed on the outer surface of the tube to maintain a constant distance between the plurality of tubes.

An inlet header which forms a plurality of tube inlet holes corresponding to the plurality of tube may be interposed between the plurality of tubes and the inlet tank, and the exhaust gas may be distributed to the plurality of tubes from the inlet tank.

An outlet header which forms a plurality of tube outlet holes corresponding to the plurality of tubes may be interposed between the plurality of tubes and the outlet tank, and the exhaust gas may be exhausted to the outlet tank from the plurality of tubes.

An inlet tank hole communicated with the exhaust inlet of the cover plate and a header inlet inserting portion for mounting the inlet header may be formed in the inlet tank.

An header outlet inserting portion for mounting the outlet header and an outlet tank hole communicates with the exhaust outlet of the cover plate may be formed in the outlet tank.

A cover bending portion which is bent to the opposite side of the cylinder block may be formed on the outer side of the cover plate.

Guide protrusions may be formed to guide the flow of the coolant and the guide protrusions may be formed to be protruded toward the mounting space.

Plurality of protrusions may be protruded toward the opposite side of the mounting space in order to prevent noise generated at an engine from being transmitted to the outside.

The EGR cooler may further include a gasket disposed between the cover plate and the cylinder block.

The EGR cooler may further include an inlet pipe installed in the exhaust inlet of the cover plate; and an outlet pipe installed in the exhaust outlet of the cover plate.

The inlet pipe and the outlet pipe may be formed as a bellows shape having a corrugation.

The EGR cooler may further include an inlet flange mounted to the inlet pipe; and an outlet flange mounted to the outlet pipe.

According to an exemplary embodiment of the present invention as described above, the cover plate, the inlet tank and the outlet tank manufactured by the pressing process are assembled by welding, thereby simplifying the structure of the EGR cooler and reducing material cost and total weight.

BRIEF DESCRIPTION OF THE DRAWINGS

The drawings are used to be referred to in describing exemplary embodiments of the present invention, so a technical concept of the present invention should not be meant to restrict the invention to the accompanying drawings.

Figure 1:
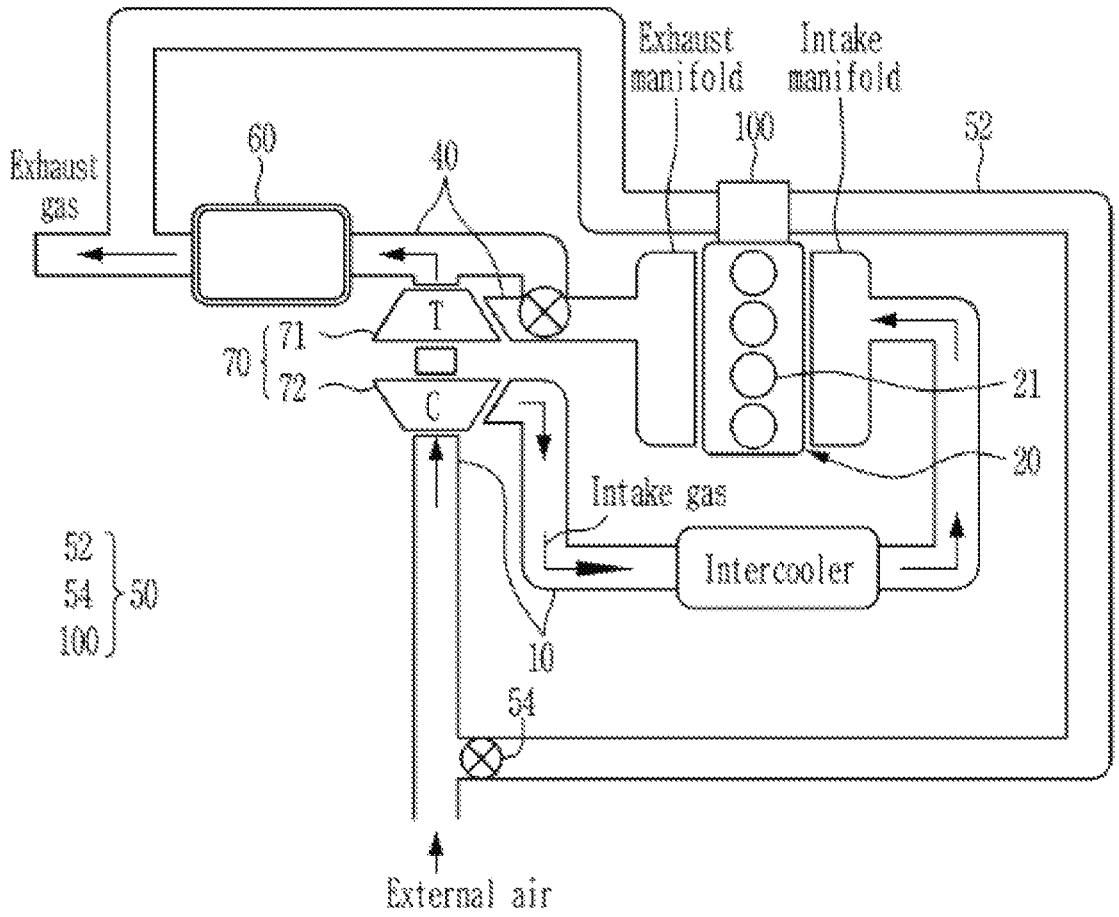
FIG. 1 is a view illustrating a configuration of an engine system to which an exhaust gas recirculation (EGR) cooler according to an exemplary embodiment of the present invention is applied.

The following reference numerals can be used in conjunction with the drawings:

10: intake line
20: engine
21: combustion chamber
30: cylinder block
31: mounting space
33: coolant inlet
35: coolant outlet
40: exhaust line
50: exhaust gas recirculation device
52: EGR line
54: EGR valve
60: catalytic converter
70: turbocharger
71: turbine
72: compressor
100: EGR cooler
110: tube
111: spacer
120: inlet tank
122: inlet tank hole
124: header inlet inserting portion
130: outlet tank
132: outlet tank hole
134: header outlet inserting portion
140: inlet header
142: tube inlet hole
144: inlet header bending portion
150: outlet header
152: tube outlet hole
154: outlet header bending portion
160: cover plate
161: exhaust inlet
162: exhaust outlet
163: cover bending portion
165: protrusion
167: guide protrusion
169: cover engage hole
170: gasket
172: gasket engage hole
180: inlet pipe, outlet pipe
180': outlet pipe
182: brazing portion
190: inlet flange, outlet flange
190': outlet flange
192: flange engage hole

DETAILED DESCRIPTION OF ILLUSTRATIVE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In order to clarify the present invention, parts irrespective of description will be omitted, and similar reference numerals are used for the similar parts throughout the specification.

The size and thickness of each element are arbitrarily illustrated in the drawings, and the present invention is not necessarily limited thereto. In the drawings, the thickness of layers, films, panels, regions, etc., are exaggerated for clarity.

First, an engine system to which an exhaust gas recirculation (EGR) cooler according to an exemplary embodiment of the present invention is applied will be described with reference to FIG. 1.

FIG. 1 is a view illustrating a configuration of an engine system to which an exhaust gas recirculation (EGR) cooler according to an exemplary embodiment of the present invention is applied.

As illustrated in FIG. 1, the engine system to which an EGR cooler 100 according to an exemplary embodiment of the present invention is applied may include an engine 20 and an exhaust gas recirculating device 50.

The engine 20 includes a plurality of combustion chambers 21 for generating power necessary for driving of a vehicle by combustion of fuel, and the engine 20 is connected to an intake line 10 through which an intake gas supplied to the combustion chambers 21 flows and an exhaust line 40 through which an exhaust gas discharged from the combustion chambers 21 flows.

The exhaust line 40 is provided with a catalytic converter 60 for purifying various harmful substances contained in the exhaust gas discharged from the combustion chambers 21. The catalytic converter 60 may include a three-way catalyst (TWC).

The engine system of the present invention may further include a turbocharger 70 for compressing intake air supplied to the combustion chambers 21.

The turbocharger 70 compresses an intake gas (external air+recirculation gas) flowing through the intake line 10 and supplies the compressed air to the combustion chambers 21. The turbocharger 70 includes a turbine 71 provided in the exhaust line 40 and rotated by the exhaust gas discharged from the combustion chambers 21 and a compressor 72 cooperatively rotated with the turbine 71 and compressing the intake gas.

The exhaust gas recirculation apparatus 50 includes an EGR line 52, an EGR cooler 100, and an EGR valve 54.

The EGR line 52 is branched from the exhaust line 40 downstream of the turbine 71 and joins the intake line 10 upstream of the compressor 72. The EGR cooler 100 is disposed at the EGR line and cools the exhaust gas flowing through the EGR line 52. The EGR valve 54 is disposed at a position where the EGR line and the intake line 10 join and regulates the amount of a recirculation gas flowing to the intake line 10. Here, the exhaust gas supplied to the intake line 10 through the recirculation line 52 is called a recirculation gas.

As the exhaust gas recirculation apparatus 50, a low pressure exhaust gas recirculation apparatus will be described as an example. However, the present invention is not limited thereto and may also be applied to a high pressure exhaust gas recirculation apparatus.

Hereinafter, an EGR cooler according to an exemplary embodiment of the present invention will be described in detail with reference to the accompanying drawings.

Figure 2:
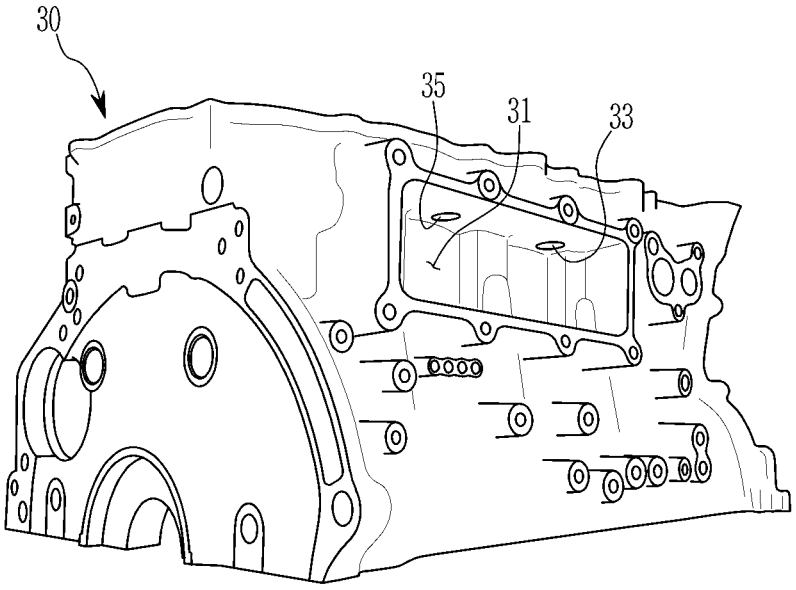
FIG. 2 is a partial perspective view illustrating a configuration of a cylinder block according to an exemplary embodiment of the present invention.
Figure 3:
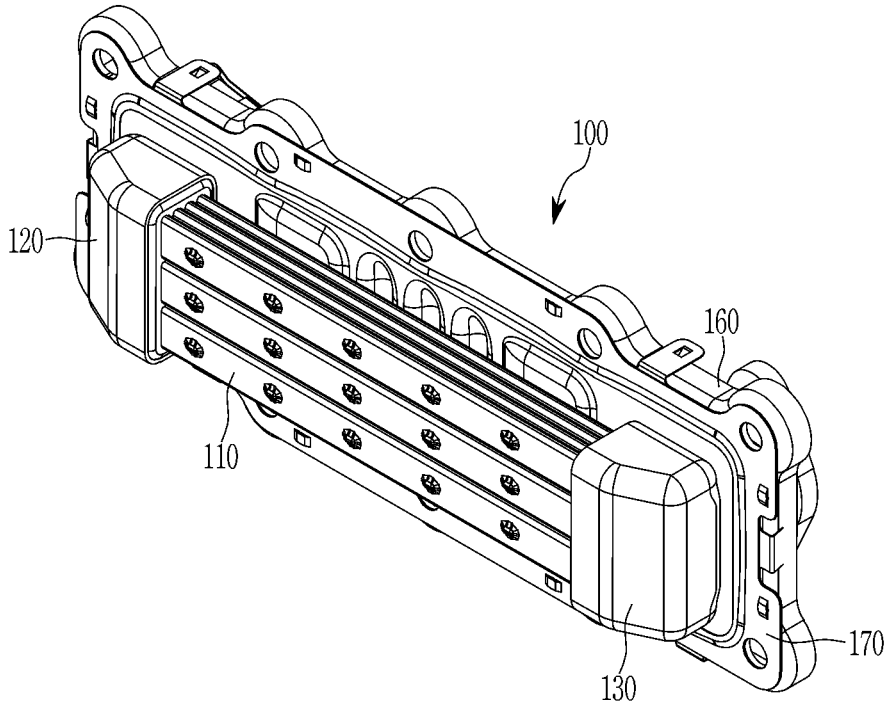
FIG. 3 is a perspective view illustrating an EGR cooler according to an exemplary embodiment of the present invention.
Figure 4:
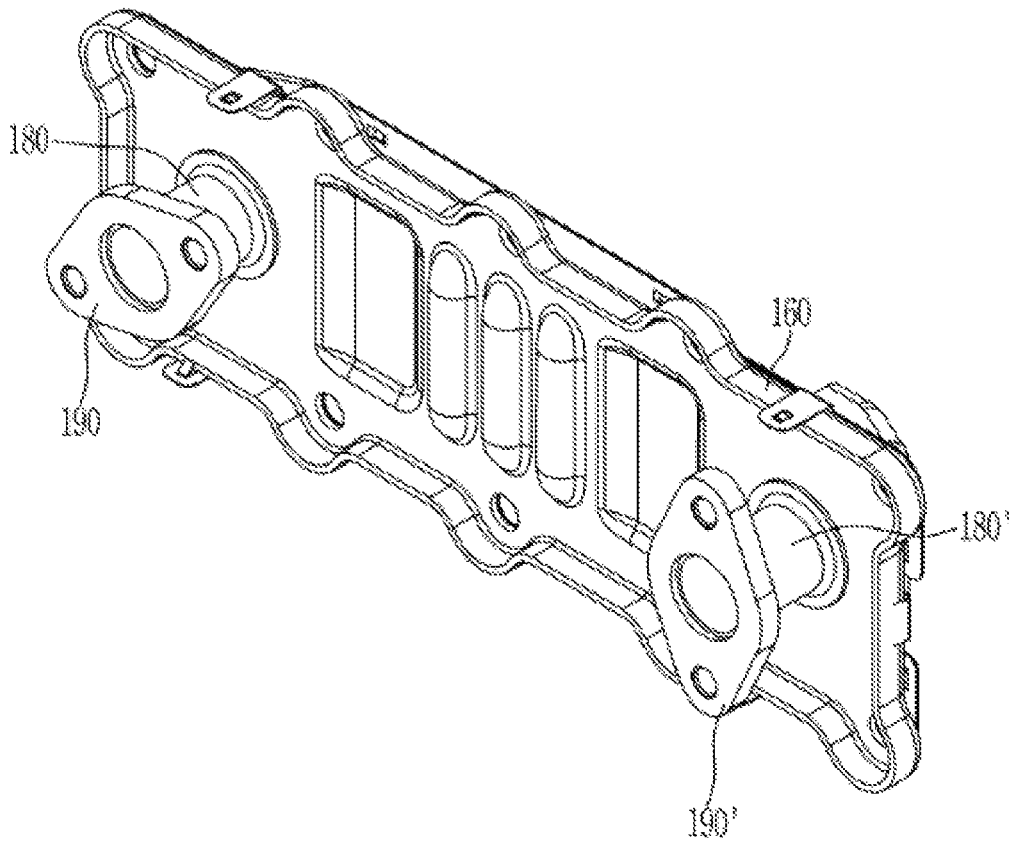
FIG. 4 is a perspective view illustrating an EGR cooler according to an exemplary embodiment of the present invention in a different direction.
Figure 5:
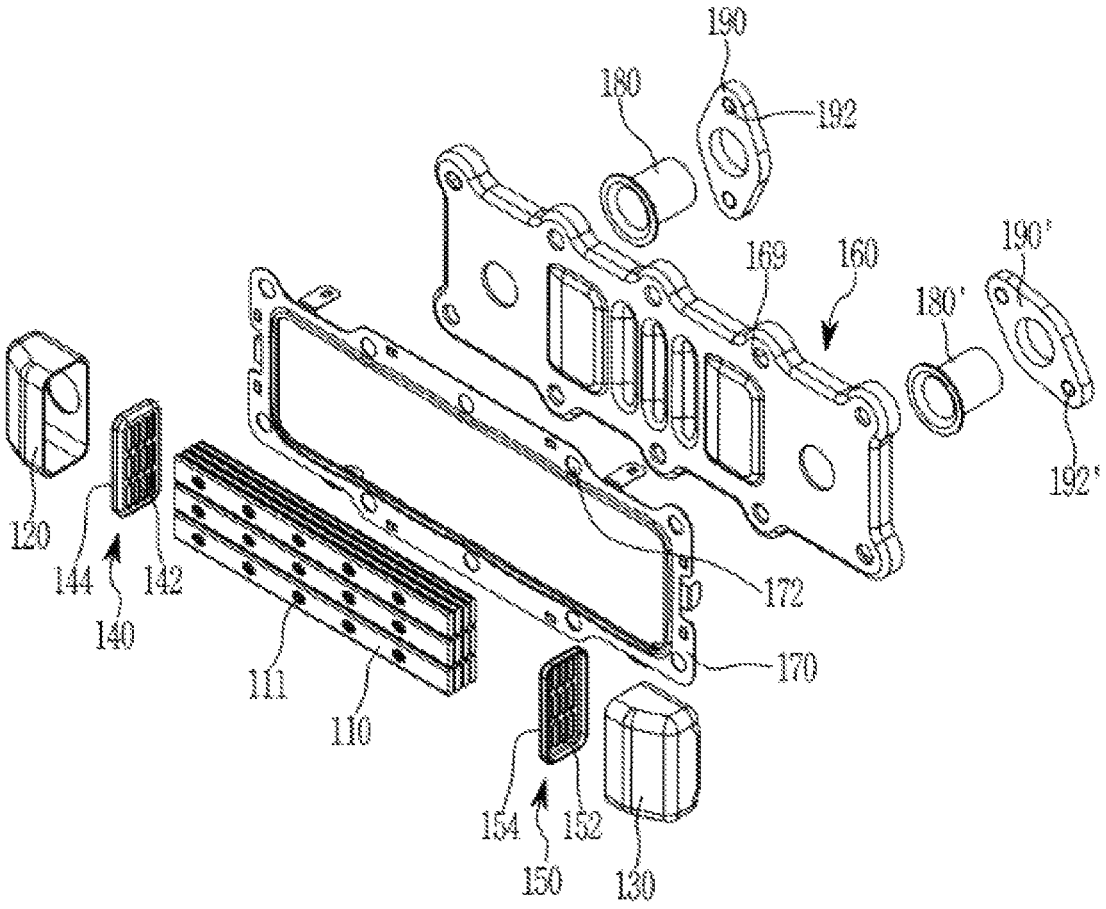
FIG. 5 is an exploded perspective view illustrating an EGR cooler according to an exemplary embodiment of the present invention.

FIG. 2 is a partial perspective view illustrating a configuration of a cylinder block according to an exemplary embodiment of the present invention. FIG. 3 is a perspective view illustrating an EGR cooler according to an exemplary embodiment of the present invention. FIG. 4 is a perspective view illustrating an EGR cooler according to an exemplary embodiment of the present invention in a different direction.

The EGR cooler 100 according to an exemplary embodiment of the present invention may include a cover plate 160 covering a mounting space 31 formed in a cylinder block 30, a plurality of tube tubes 110 mounted in the mounting space 31, an inlet tank 120 guiding exhaust gas flowing in through the cover plate 160 to the plurality of tubes 110, and an outlet tank 130 exhausting exhaust gas exhausted from the plurality of tubes 110 to outside of the cover plate 160.

Referring to FIG. 2, a plurality of combustion chambers 21 are formed in the cylinder block 30, and the mounting space 31 is formed on the outer side. A coolant inlet 13 and a coolant outlet 35 which are fluidly communicated with a water jacket (not shown) are formed inside of the mounting space 31.

Referring to FIG. 3, in the mounting space 31, the plurality of tubes 110 are stacked in left-and-right direction and up-and-down direction, and the mounting space forms a closed space by the cover plate 160.

The tube 110 is formed as a pipe shape having both ends open so that exhaust gas flows therein, and may be formed into a hexahedron or cylinder shape having a long length.

Coolant passages through which coolant flowing through the coolant inlet 13 flows are formed between the plurality of tubes 110. That is, the coolant passages may be formed between an inner side of the mounting space 31 and the corresponding tubes 110, between the adjacent tubes 110, and between the cover plate 160 and the corresponding tubes 110.

Figure 6:
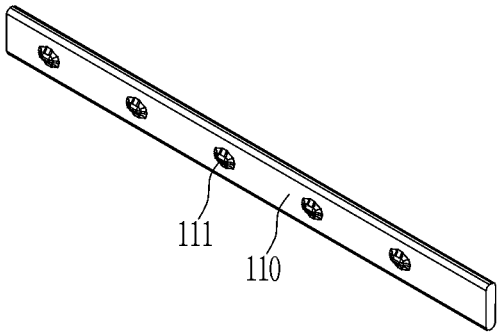
FIG. 6 is a perspective view illustrating a tube according to an exemplary embodiment of the present invention.

As shown in FIG. 6, a spacer 111 may be formed on the outer surface of the tube 110 to maintain a constant distance between the plurality of tubes 110 stacked in the vertical direction. A plurality of the spacers 111 may be formed, and a plurality of spacers 111 may be formed with a predetermined spacing.

Figure 8:
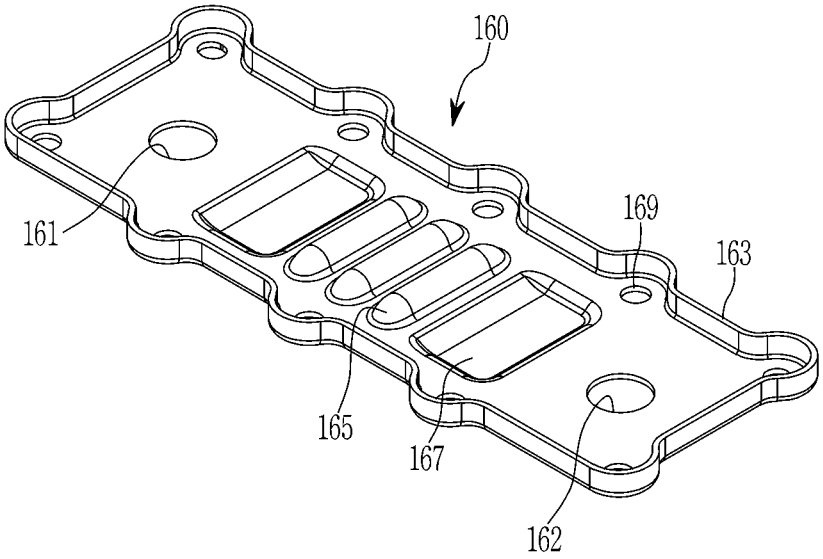
FIG. 8 is a perspective view illustrating a cover plate according to an exemplary embodiment of the present invention.

Referring to FIG. 8, the cover plate 160 is formed in a substantially quadrangular plate shape, and an exhaust inlet 161 through which an exhaust gas is inflow is formed at one side of the cover plate 160 and an exhaust outlet 162 through which exhaust gas is exhausted is formed at the other side of the cover plate 160. The cover plate 160 may be manufactured by pressing a metal plate.

A cover bending portion 163, which is bent to the opposite side of the cylinder block, is formed on the outer side of the cover plate 160. The cover bending portion 163 serves to reinforce the rigidity of the cover plate 160.

At the central portion of the cover plate 160, a plurality of protrusions 165 are formed protruding toward the opposite side of the mounting space 31 of the cylinder block 30. The plurality of protrusions 165 prevent noise generated at the engine 20 from being transmitted to the outside.

In detail, when the coolant flows through the coolant passage formed between the cover plate 160 and the tube 110, a flow rate change occurs by protrusion 165. Therefore, the noise generated when the coolant passes through the coolant passage is reduced, and the noise is not transmitted to the outside.

At both sides of the protrusion 165, guide protrusions 167 are formed to guide the flow of the coolant in the mounting space. The guide protrusions 167 serve to keep the spacing of the coolant passages formed between the cover plate 160 and the tube 110 adjacent to the cover plate 160 uneven. Therefore, the guide protrusions 167 change the pressure of the coolant flowing through the coolant passage formed between the cover plate 160 and the tube 110, thereby the flow rate of the coolant flowing through the coolant passage is changed.

Meanwhile, cover engage holes 169 are formed on the cover plate 160, and block engage holes corresponding to the cover engage holes 169 are formed on the mounting space 31. After the cover plate 160 is seated in the cylinder block, an engage bolt passing through the cover engage hole 169 is screwed into the block engage hole to join the cover plate 160 and the cylinder block.

A gasket 170 is installed between the cover plate 160 and the cylinder block to close and seal the mounting space 31 of the cylinder block 30 with the outside to prevent the coolant flowing in the mounting space from leaking to the outside. Gasket engage holes 172 corresponding to the cover engage hole 169 of the cover plate 160 are formed in the gasket 170.

Exhaust gas that is flowing through the exhaust inlet 161 of the cover plate 160 is distributed to the plurality of tubes 110 through the inlet tank 120. At this time, an inlet header 140 is interposed between the inlet tank 120 and the plurality of tubes 110, and exhaust gas passing through the inlet tank 120 is distributed to a plurality of tubes 110.

The exhaust gas passing through a plurality of tubes 110 is guided by the outlet tank 130 and exhausted to the outside through the exhaust outlet 162 of the cover plate 160. At this time, an outlet header 150 is interposed between the plurality of tubes 110 and the outlet tank 130, and exhaust gas passing through the plurality of tubes 110 is collected in the outlet tank 130.

Figure 7:
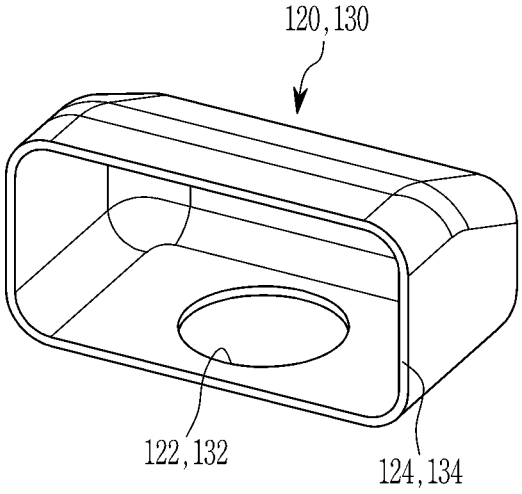
FIG. 7 is a perspective view illustrating a tank according to an exemplary embodiment of the present invention.

Referring to FIG. 7, the inlet tank 120 is formed as an empty polygon, an inlet tank hole 122 communicating with the exhaust inlet 161 of the cover plate 160 is formed at one side of the inlet tank 120, and a header inlet inserting portion 124 for mounting the inlet header 140 is formed at the other side of the inlet tank 120. The inlet tank 120 and the cover plate 160 may be fixed by brazing welding.

A plurality of tube inlet holes 142 corresponding to the tubes 110 are formed in the inlet header 140, and an inlet header bending portion 144 is formed at an outer portion of the inlet header 140 so as to be inserted into the header inlet inserting portion 124. The plurality of tube inlet holes 142 may be formed in a quadrangle or circular shape depending on the shape of the end of the tube 110. The inlet header bending portion 144 is inserted into the header inlet inserting portion 124 of the inlet tank 120 to assemble the inlet header 140 and the inlet tank 120.

Referring to FIG. 7, the outlet tank 130 may have the same shape as the inlet tank 120. That is, the outlet tank 130 is formed as an empty polygon, a header outlet inserting portion 134 for mounting the outlet header 150 is formed at one side of the outlet tank 130, and an outlet tank hole 132 communicating with the exhaust outlet 162 of the cover plate 160 is formed at the other side of the outlet tank 130. The outlet tank 130 and the cover plate 160 may be fixed by brazing welding.

The outlet header 150 may have the same shape as the inlet header 14*o*. That is, a plurality of tube outlet holes 152 corresponding to the tubes 110 are formed in the outlet header 150, and an outlet header bending portion 154 is formed at an outer portion of the outlet header 150 so as to be inserted into the header outlet inserting portion 134. The plurality of tube outlet holes 152 may be formed in a quadrangle or circular shape depending on the shape of the end of the tube 110.

The outlet header bending portion 154 is inserted into the header outlet inserting portion 134 of the outlet tank 130 to assemble the outlet header 150 and the outlet tank 130.

In this way, the inlet tank 120 and the outlet tank 130 are formed in the same shape, and the inlet header 140 and the outlet header 150 are formed in the same shape, thereby reducing manufacturing cost.

The EGR line is disposed in the exhaust inlet 161 of the cover plate 160. The EGR line is assembled to an inlet pipe and an outlet pipe through an inlet flange and an outlet flange.

In detail, the inlet pipe 180 of a cylinder shape is fixedly installed in an exhaust inlet 161 of the cover plate 160, and the outlet pipe 180' of a cylinder shape is fixedly installed at the exhaust outlet 162. The inlet pipe 180 and the outlet pipe 180' can be fixed to the exhaust inlet 161 and the exhaust outlet 162 through a brazing welding.

Figure 9:
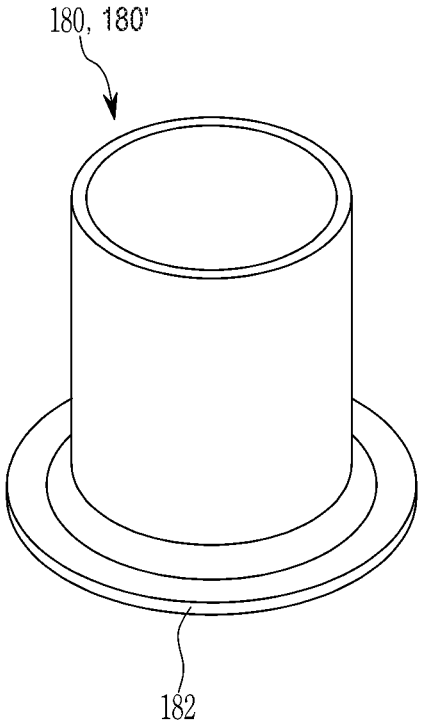
FIG. 9 is a perspective view illustrating an inlet or an outlet pipe according to an exemplary embodiment of the present invention.

For this purpose, the inlet pipe 180 and the outlet pipe 180' may have a brazing portion 182 formed at an end thereof extending radially outward (see FIG. 9). The brazing portion 182 is contacted to the outside of the exhaust inlet 161 and the exhaust outlet 162, and the cover plate 160, the inlet pipe 180 and the outlet pipe 180' are fixed through the brazing welding.

Figure 10:
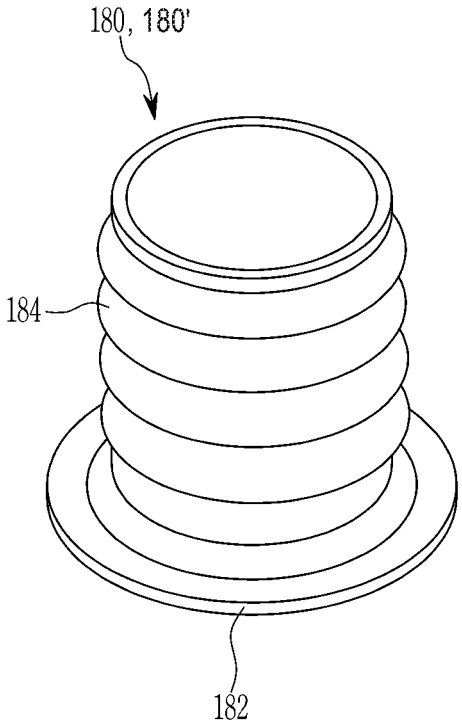
FIG. 10 is a perspective view illustrating an inlet or an outlet pipe according to another exemplary embodiment of the present invention.

The body of the inlet pipe 180 and the outlet pipe 180' may be formed as a bellows shape having a corrugation 184 (see FIG. 10). By forming the inlet pipe 180 and the outlet pipe 180' in the bellows shape, the anti-vibration characteristics of the inlet pipe 180 and the outlet pipe 180' can be improved and the thermal fatigue characteristic can be improved.

The inlet pipe 180 and the outlet pipe 180' may be formed in the same shape. Therefore, by using the inlet pipe 180 and the outlet pipe 180' having the same shape, the manufacturing cost can be reduced.

An inlet flange 190 and an outlet flange 190' are fixedly mounted to the ends of the inlet pipe 180 and the outlet pipe 190', respectively. The EGR line 52 is fixedly mounted to the inlet flange 190 and the outlet flange 190', respectively. The inlet flange 190 and the outlet flange 190 may be formed in the same shape. Thus, by using inlet flange 190 and outlet flange 190' having the same shape, manufacturing cost can be reduced.

Flange engage holes 192 are formed on both sides of the inlet flange 190 and the outlet flange 190', and the EGR line 52 is assemble assembled through the flange engage hole 192.

Hereinafter, the operation of the EGR cooler according to an exemplary embodiment of the present invention as described above will be described in detail.

The exhaust gas flowing through the EGR line is flowing into the exhaust inlet 161 of the cover plate 160 via the inlet flange 190 and the inlet pipe 180. Exhaust gas flowing into the exhaust inlet 161 of the cover plate 160 is distributed to the plurality of tubes 110 via an inlet tank 120 and an inlet header 140 and flows through the plurality of tubes 110.

At the same time, a portion of the cooling water which has circulated through a water jacket (not shown) of the cylinder block 30 is introduced to the mounting space 31 through the cooling water inlet 33 formed at the cylinder block 30.

The exhaust gas flowing through the plurality of tube 110 is heat-exchanged with the coolant introduced to the mounting space, and thus, a temperature of the exhaust gas is lowered.

The exhaust gas, which is lowered in temperature by the heat exchange with the coolant, is temporarily collected from the plurality of tubes 110 through the outlet header 150 to the outlet tank 130. The exhaust gas temporarily collected in the outlet tank 130 is exhausted to the EGR line 52 via the outlet pipe 180' and the outlet flange 190' installed on the cover plate 160.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. An EGR (exhaust gas recirculation) cooler comprising:

a cylinder block having a mounting space and having a coolant inlet through which a coolant can flow into the mounting space and a coolant outlet through which the coolant can be exhausted;

a cover plate covering the mounting space and forming an exhaust inlet through which an exhaust gas can flow in and an exhaust outlet through which the exhaust gas can be exhausted;

a plurality of tubes mounted in the mounting space and through which the exhaust gas can flow, each tube of the plurality of tubes having a first open end and a second open end opposite the first open end;

an inlet tank mounted in the mounting space and configured to distribute the exhaust gas flowing through the exhaust inlet of the cover plate to the first open ends of the tubes;

an outlet tank mounted in the mounting space and configured to guide the exhaust gas exhausted from the second open ends of the tubes to the exhaust outlet of the cover plate;

an inlet header comprising a plurality of tube inlet holes corresponding in size and shape to the first open ends of the plurality of tubes, the inlet header interposed between the first open ends of the plurality of tubes and the inlet tank, wherein the exhaust gas can be distributed to the first open ends of the plurality of tubes from the inlet tank; and an outlet header comprising a plurality of tube outlet holes corresponding in size and shape to the second open ends of the plurality of tubes, the outlet header interposed between the second open ends of the plurality of tubes and the outlet tank, wherein the exhaust gas can be exhausted to the outlet tank from the second open ends of the plurality of tubes.

2. The EGR cooler of claim 1, wherein the plurality of tubes are stacked in a left-and-right direction and an up-and-down direction.

3. The EGR cooler of claim 2, further comprising a spacer formed on an outer surface of the plurality of tubes to maintain a constant distance between the plurality of tubes.

4. The EGR cooler of claim 1, wherein the outlet header includes a portion that mounts to the outlet tank and an outlet tank hole communicated with the exhaust outlet of the cover plate formed in the outlet tank.

5. The EGR cooler of claim 1, wherein the inlet tank includes an inlet tank hole communicated with the exhaust inlet of the cover plate and an insertion portion that mounts to the inlet header.

6. The EGR cooler of claim 1, wherein a cover bending portion, which is bent to an opposite side of the cylinder block, is formed on an outer side of the cover plate.

7. The EGR cooler of claim 1, wherein guide protrusions are formed to guide the flow of the coolant, the guide protrusions being protruded toward the mounting space.

8. The EGR cooler of claim 1, wherein a plurality of protrusions are protruded toward an opposite side of the mounting space in order to prevent noise generated at an engine from being transmitted outside.

9. The EGR cooler of claim 1, further comprising a gasket disposed between the cover plate and the cylinder block.

10. The EGR cooler of claim 1, further comprising:

an inlet pipe installed in the exhaust inlet of the cover plate; and an outlet pipe installed in the exhaust outlet of the cover plate.

11. The EGR cooler of claim 10, wherein the inlet pipe and the outlet pipe are formed as a bellows shape having a corrugation.

12. The EGR cooler of claim 10, further comprising:

an inlet flange mounted to the inlet pipe; and an outlet flange mounted to the outlet pipe.

13. An engine system comprising:

an engine including a plurality of combustion chambers;

an intake line through which an intake gas can be supplied to the combustion chambers;

an exhaust line through which an exhaust gas discharged from the combustion chambers can flow;

a catalytic converter in line with the exhaust line;

a turbocharger including a turbine provided in the exhaust line and configured to be rotated by the exhaust gas discharged from the combustion chambers and a compressor to be cooperatively rotated with the turbine;

an exhaust gas recirculating (EGR) device that includes an EGR line branched from the exhaust line downstream of the turbine and joining the intake line upstream of the compressor, an EGR cooler disposed at the EGR line, and an EGR valve disposed at a position where the EGR line and the intake line join, wherein the EGR cooler comprises:

a cylinder block having a mounting space and having a coolant inlet through which a coolant can flow into the mounting space and a coolant outlet through which the coolant can be exhausted;

a cover plate covering the mounting space and forming an exhaust inlet though which an exhaust gas can flow in and an exhaust outlet through which the exhaust gas can be exhausted;

a plurality of tubes mounted in the mounting space and through which the exhaust gas can flow, each tube of the plurality of tubes having a first open end and a second open end opposite the first open end;

an inlet tank mounted in the mounting space and configured to distribute the exhaust gas flowing through the exhaust inlet of the cover plate to the first open ends of the tubes;

an outlet tank mounted in the mounting space and configured to guide the exhaust gas exhausted from the second open ends of the tubes to the exhaust outlet of the cover plate;

an inlet header comprising a plurality of tube inlet holes corresponding to the first open ends of the plurality of tubes, the inlet header interposed between the first open ends of the plurality of tubes and the inlet tank, wherein the exhaust gas can be distributed to the first open ends of the plurality of tubes from the inlet tank; and an outlet header comprising a plurality of tube outlet holes corresponding to the second open ends of the plurality of tubes, the outlet header interposed between the second open ends of the plurality of tubes and the outlet tank, wherein the exhaust gas can be exhausted to the outlet tank from the second open ends of the plurality of tubes.

14. The engine system of claim 13, wherein the EGR device is a low pressure exhaust gas recirculation apparatus.

15. The engine system of claim 13, wherein the EGR device is a high pressure exhaust gas recirculation apparatus.

16. The engine system of claim 13, wherein the EGR cooler further comprises a plurality of spacers disposed on an outer surface of the plurality of tubes and provided to maintain a constant distance between the plurality of tubes.

17. The engine system of claim 13, wherein the plurality of tube inlet holes correspond in size and shape to the first open ends of the plurality of tubes, and wherein the plurality of tube outlet holes correspond in size and shape to the second open ends of the plurality of tubes.

18. The engine system of claim 13, wherein each tube of the plurality of tubes has a hexahedron or cylindrical shape.

19. An EGR (exhaust gas recirculation) cooler comprising:

a cylinder block having a mounting space and having a coolant inlet through which a coolant can flow into the mounting space and a coolant outlet through which the coolant can be exhausted;

a cover plate covering the mounting space and forming an exhaust inlet through which an exhaust gas can flow in and an exhaust outlet through which the exhaust gas can be exhausted;

a plurality of tubes mounted in the mounting space and through which the exhaust gas can flow, each tube of the plurality of tubes having a first open end and a second open end opposite the first open end;

an inlet tank mounted in the mounting space and configured to distribute the exhaust gas flowing through the exhaust inlet of the cover plate to the first open ends of the tubes;

an outlet tank mounted in the mounting space and configured to guide the exhaust gas exhausted from the second open ends of the tubes to the exhaust outlet of the cover plate;

an inlet header comprising a plurality of tube inlet holes corresponding in size and shape to the first open ends of the plurality of tubes, the inlet header interposed between the first open ends of the plurality of tubes and the inlet tank, wherein the exhaust gas can be distributed to the plurality of tubes from the inlet tank;

an inlet tank hole communicated with the exhaust inlet of the cover plate and an insertion portion that mounts to the inlet header; and an outlet header comprising a plurality of tube outlet holes corresponding in size and shape to the second open ends of the plurality of tubes, the outlet header interposed between the second open ends of the plurality of tubes and the outlet tank, wherein the exhaust gas can be exhausted to the outlet tank from the plurality of tubes;

wherein the outlet header includes a portion that mounts to the outlet tank and an outlet tank hole communicated with the exhaust outlet of the cover plate formed in the outlet tank;

wherein an inlet header bending portion is formed at an outer portion of the inlet header so as to be inserted into the insertion portion; and wherein an outlet header bending portion is formed at an outer portion of the outlet header so as to be inserted into the portion of the outlet header that mounts to the outlet tank.

20. The EGR cooler of claim 19, further comprising a spacer formed on an outer surface of the plurality of tubes to maintain a constant distance between the plurality of tubes.

* * * * *